United States Patent [19]

Gutner

[11] 4,199,041

[45] Apr. 22, 1980

[54] BUNK BED-LADDER ARRANGEMENT

[76] Inventor: Kenneth H. Gutner, Dato, Highland Park, Ill. 62249

[21] Appl. No.: 967,495

[22] Filed: Dec. 7, 1978

[51] Int. Cl.[2] ..... E06C 7/48; E06C 1/36

[52] U.S. Cl. ..... 182/206; 182/46

[58] Field of Search ..... 182/206, 106, 46, 150

[56] References Cited

U.S. PATENT DOCUMENTS

| | | | |
|---|---|---|---|
| 468,493 | 2/1892 | Charles | 182/206 |
| 2,333,849 | 11/1943 | Driscoll | 182/206 |
| 2,364,521 | 12/1944 | Fairfax | 182/206 |
| 2,839,765 | 6/1958 | Cogley | 182/206 |
| 3,360,075 | 12/1967 | Gutner | 182/206 |
| 3,557,906 | 1/1971 | Gutner | 182/206 |

*Primary Examiner*—Reinaldo P. Machado

*Attorney, Agent, or Firm*—Tilton, Fallon, Lungmus & Chestnut

[57] ABSTRACT

A bunk bed-ladder arrangement wherein the upper end of the ladder is equipped with C-shaped hook members which straddle the bunk bed rail, the hook members having aligned openings for insertion of screws to secure the hook members to the ladder and the bed rail being equipped with a bracket having a detent fitting into an opening for stabilizing the ladder in position.

6 Claims, 4 Drawing Figures

BUNK BED-LADDER ARRANGEMENT

BACKGROUND AND SUMMARY OF THE INVENTION

This invention relates to a bunk bed-ladder arrangement and, more particularly, to a novel hook and bracket connection for stabilizing the ladder in place on the bed rail.

It will be apparent that the stability of a bunk bed ladder is critical to its safety. This is the goal which has been sought in my prior U.S. Pat. Nos. 3,360,075 and 3,557,906. The instant invention constitutes an improvement thereover and employs a novel hook and bracket combination for stabilization and, therefore, safety.

More particularly, the hook is generally C-shaped and in the leg portions thereof is equipped with aligned openings so that a wood screw can be inserted through the larger openings in one leg to extend partially through the smaller opening in the other leg and thus be secured to the top end of the ladder. The bracket is centrally step-shaped so as to receive the first mentioned leg of the hook member and additionally is equipped with a detent or upset portion which projects into one of the larger openings in the hook so as to provide an overcomeable lock but one which is effective to stabilize the ladder against inadvertent displacement.

DETAILED DESCRIPTION

The invention is described in conjunction with an illustrative embodiment in the accompanying drawing, in which FIG. 1 is a fragmentary perspective view, partially broken away and partially in exploded form to illustrate the components of the invention and the method of assemblying the same;

Figure 1:
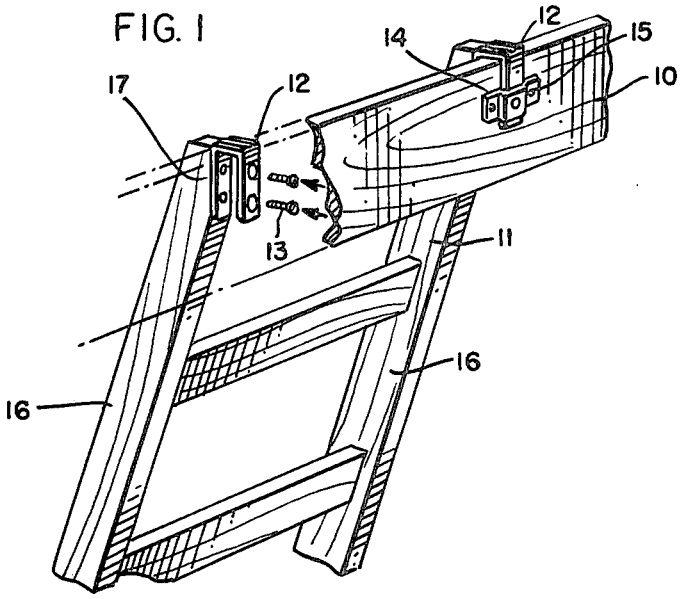

In the illustration given and with reference first to FIG. 1, the numeral 10 designates the side rail of a bunk bed. The numeral 11 designates a ladder which is hookingly engaged via hooks 12 with the rail 10. The hooks 12 are secured to the ladder 11 by means of wood screws 13. Completing the assembly are brackets 14 which are secured to the inside of the side rail 10 by means of further screws 15.

Still referring to FIG. 1, it will be noted that the ladder 11 is made up of side pieces 16. Each side piece 16 is beveled as at 17 to provide the mounting for the C-shaped hook member 12. The hook member 12 thus can straddle the side rail 10 which has a generally rectangular cross section.

Figure 2:
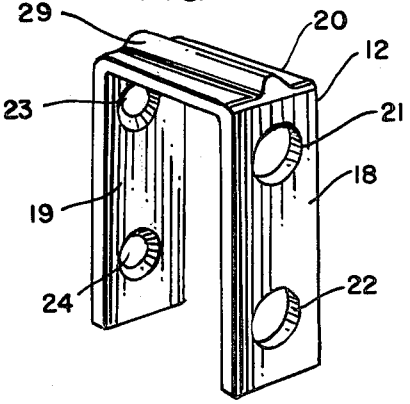
FIG. 2 is a perspective view of the hook member of FIG. 1 but in larger scale.

Referring now to FIG. 2, it will be seen that the hook member 12 is a unitary member having legs 18 and 19 depending from a connective bight portion 20—thus forming the previously referred to C-shape.

Still referring to FIG. 2, it will be noted that each of the legs 18 and 19 is equipped with a pair of openings, viz., 21, 22 relative to the leg 18 and 23, 24 relative to the leg 19. The openings in the leg 18 are aligned with the openings in the leg 19, viz., openings 21 and 23 are aligned horizontally while openings 22 and 24 are also horizontally aligned but at a slightly lower elevation. It will be further noted that the openings 21, 22 in the leg 18 are larger than the openings in the openings 23, 24 in the leg 19. This permits the insertion of the wood screws 13 (as indicated in FIG. 1) through the openings 21 and 22. However, the openings 23 and 24 are smaller so that the heads of the wood screws 13 abut the interior of the leg 19 for securing the hook member 12 to the ladder side piece 16. In the illustration given, the openings 23 and 24 are countersunk so as to achieve a substantially flush mounting of the wood screws 13.

Figure 3:
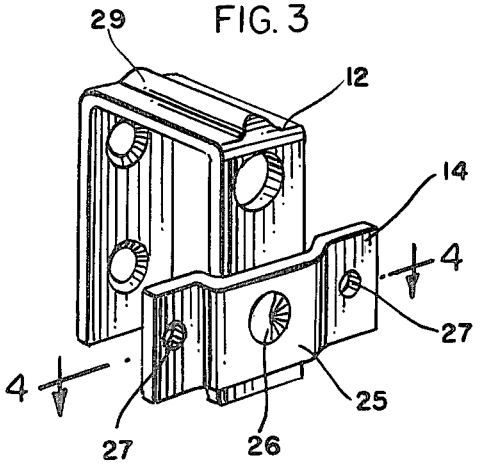
FIG. 3 is a view similar to FIG. 2 but showing the bracket positioned adjacent the hook member in the manner illustrated in FIG. 1.

Referring now to FIG. 3, the hook member 12 is seen in combination with the bracket 14. The bracket 14 is seen to be relatively elongated in what is normally the horizontal direction and this provides a stepped central portion 25 which is advantageously equipped with a detent or upset portion 26 (see particularly the upper central portion of FIG. 4). The detent 26 is adapted to extend into one of the openings (as at 22) in the leg 18 when the hook member 12 straddles the side rail 10 in the fashion seen in the upper right hand portion of FIG. 1.

For securing the brackets 14 to the inside of the side rails 10, suitable screw openings 27 are provided adjacent to but spaced from the ends of the brackets 14.

Figure 4:
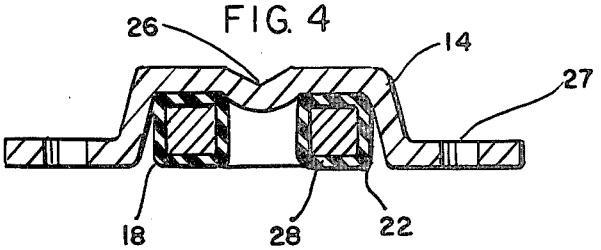
FIG. 4 is a sectional view taken along the sight line 4—4 applied to FIG. 3.

In the illustration given, I have found it advantageous to provide the hook member 12 of metal such as ⅛" thick steel but coated (as by dipping) with polyvinyl chloride to provide a slightly resilient covering as indicated at 28 in FIG. 4. This serves to prevent the ladder hooks from scaring or otherwise damaging the furniture or if inadvertently moved against a person from causing a sharp cut or the like. The brackets 14 are advantageously constructed of 16 gauge steel which provides sufficient strength to permit the development of the stepped portion 25 without undue deformation, possibility of cracking, etc.

In the illustration given, the upper ends of the ladder side pieces 16 are beveled so that the hook member 12 can be made with the legs at essentially right angles, i.e., C-shaped or U-shaped. It will be apparent from a consideration of the invention that if the beveling of the ladder side pieces 16 is inadvisable for some reason, the invention may be practiced by opening the hook member 12—as by making the angle between the leg 19 and the bight portion 20 oblique. Although the stradding function may be decreased somewhat by this modification, the provision of the detent 26 will assist in maintaining advantageous stability of the hook member 12 relative to the side rail 10.

Also assisting in stabilizing and reinforcing the hook member is the integral rib 29 extending along the bight portion 20.

While in the foregoing specification a detailed description of an embodiment of the invention has been set down for the purpose of illustration, many variations in the details hereingiven may be made by those skilled in the art without departing from the spirit and scope of the invention.

I claim:

1. In combination, a bunk bed having an upper side-defining wooden rail having a rectangular cross-section, a ladder having a C-shaped hook member secured at the upper end of each side piece adapted to straddle said rail, each member having a pair of legs depending from a connective bight portion, a pair of openings in each leg with the openings in one leg being aligned with the openings in the other leg and with the openings in said one leg being larger than the openings in said other leg whereby a screw is insertable through an opening in said one leg to extend through the aligned opening in the other leg to secure said other leg to the ladder side piece, and a pair of relatively elongated brackets on said rail having a stepped central portion each adapted to receive said one leg, and a detent in said central portion extending into one of said leg openings when said members are in straddle relation on said rail.

2. The combination of claim 1 in which said ladder has side pieces having beveled surfaces at the upper ends thereof, said member other leg being secured to said surfaces.

3. The combination of claim 1 in which each hook member has a resilient plastic covering.

4. The combination of claim 1 in which said other leg openings are countersunk at the ends thereof interiorily of said member.

5. The combination of claim 1 in which said bight portion is equipped with a reinforcing rib.

6. In combination, a bunk bed having an upper side-defining wooden rail having a rectangular cross-section, a ladder having a C-shaped hook member secured at the upper end of each side piece adapted to straddle said rail, said members being coated with resilient plastic material and each member having a leg spaced from said ladder when said member is in straddle relation on said rail, said leg being equipped with an opening, and detent-equipped bracket means on said rail operably associated with said one leg opening.

* * * * *